US007310923B2

(12) United States Patent
Taylor

(10) Patent No.: US 7,310,923 B2
(45) Date of Patent: Dec. 25, 2007

(54) TIMING GATES FOR A PACKAGING MACHINE

(75) Inventor: Alfred A. Taylor, Lugarno (AU)

(73) Assignee: TNA Australian Pty Limited, Lidcombe (AU)

( * ) Notice: Subject to any disclaimer, the term of this patent is extended or adjusted under 35 U.S.C. 154(b) by 174 days.

(21) Appl. No.: 10/371,161

(22) Filed: Feb. 21, 2003

(65) Prior Publication Data

US 2003/0230594 A1 Dec. 18, 2003

(30) Foreign Application Priority Data

Feb. 22, 2002 (AU) ..... PS0706

(51) Int. Cl.
*B65B 1/32* (2006.01)
*B65B 9/10* (2006.01)

(52) U.S. Cl. ..... 53/502; 53/551; 177/25.18; 177/59; 222/77

(58) Field of Classification Search ..... 53/451, 53/493, 504, 552, 502, 551; 177/25.18, 59; 222/77

See application file for complete search history.

(56) References Cited

U.S. PATENT DOCUMENTS

| | | | | |
|---|---|---|---|---|
| 3,070,931 | A | 1/1963 | Zwight et al. | |
| 3,842,569 | A * | 10/1974 | McClelland et al. | 53/469 |
| 4,193,465 | A | 3/1980 | Henry | |
| 4,497,385 | A * | 2/1985 | Sashiki | 177/59 |
| 4,531,598 | A | 7/1985 | Kitagawa | |
| 4,538,692 | A * | 9/1985 | Henry et al. | 177/1 |
| 5,031,386 | A * | 7/1991 | Schneider | 53/551 |
| 5,235,794 | A * | 8/1993 | Center | 53/437 |
| 5,473,866 | A * | 12/1995 | Maglecic et al. | 53/511 |
| 5,753,867 | A * | 5/1998 | Konishi et al. | 177/25.18 |
| 5,765,655 | A * | 6/1998 | Tatsuoka | 177/25.18 |
| 6,000,200 | A | 12/1999 | Germunson et al. | |
| 6,119,438 | A | 9/2000 | Bacon et al. | |
| 6,125,615 | A | 10/2000 | Germunson et al. | |
| 6,351,926 | B1 | 3/2002 | Hodge et al. | |
| 6,428,457 | B1 * | 8/2002 | Fukuda et al. | 493/302 |
| 6,605,785 | B1 * | 8/2003 | Muramiya | 177/25.18 |

FOREIGN PATENT DOCUMENTS

| | | | |
|---|---|---|---|
| EP | 0761536 | A2 | 12/1997 |
| EP | 1018470 | A1 | 7/2000 |
| EP | 1063170 | A1 | 12/2000 |
| JP | 60077909 | A | 5/1985 |
| JP | 60077910 | A | 5/1985 |
| JP | 8-114492 | A | 7/1996 |
| JP | 2001-289702 | A | 10/2001 |

* cited by examiner

*Primary Examiner*—Stephen F. Gerrity
(74) *Attorney, Agent, or Firm*—Townsend and Townsend and Crew, LLP

(57) ABSTRACT

A chute assembly to be positioned between a weigher and a former of a packaging machine. The chute assembly includes a timing gate device including a plurality of timing gates that regulates the delivery of batches of product from the weigher to the former. The gates are driven between a first position at which they inhibit the delivery of batches of product to the former and a second position permitting the flow of batches of product to the former.

13 Claims, 1 Drawing Sheet

TIMING GATES FOR A PACKAGING MACHINE

TECHNICAL FIELD

The present invention relates to packaging machines and more particularly to the amount of time product engages packaging machines.

BACKGROUND OF THE INVENTION

It is known to have a weigher to deliver batches of product to a chute extending toward a packaging machine former. A strip of bag material is delivered to the former and formed into tubular bag material thereby. Product is delivered to the interior of the tubular bag material so that upon longitudinal and transverse sealing of the tubular bag material, discreet bags of product can be provided by the packaging machine.

Batches of the product must be delivered to the former in a timed sequence in phase with the packaging machine. Typically, delivery of the product to the former is governed by means of timing gates located beneath the chute but above the former. The gates are driven so that they open and close at appropriate times in phase with the operation of the packaging machine.

The above-discussed arrangement has the disadvantage that product engaged by the gate is travelling relatively fast and can be damaged. This is particularly the case with snack foods such as potato chips or crisps.

A still further disadvantage is that when the product reaches the former, it is travelling relatively slow and therefore can often block the former.

SUMMARY OF THE INVENTION

It is an object of the present invention to overcome or substantially ameliorate at least one of the above disadvantages.

There is disclosed herein a product delivery chute assembly to extend between a weigher that provides batches of product and a packaging machine former that receives the batches to deliver the batches to the interior of tubular bag material, the assembly including:

a chute having a generally vertical longitudinal axis and a side wall surrounding the axis and converging downwardly from an upper chute portion to a lower chute portion, the lower chute portion surrounding a lower opening through which product batches are delivered to the former, the upper portion surrounding an upper opening through which product batches are delivered from the weigher, a plurality of troughs extending down the side wall and along which the batches travel after being delivered thereto by the weigher; and a timing gate device including timing gates in the chute and a motor assembly operably associated with the gates to cause movement thereof between a first position blocking the passage of the product batches along the troughs so as to retain a batch or batches of the product, and a second position releasing the batch or batches of product for movement along the chute for delivery to the lower opening, each gate being operatively associated with a respective one of the troughs to engage the batch or batches travelling along the trough.

Preferably, the timing gates are mounted in the upper chute portion so as to release product to be delivered to the lower chute portion, with the upper chute portion also having the troughs.

Preferably, the upper chute portion has a lower edge surrounding an upper chute portion lower opening through which the product is delivered to the lower chute portion.

Preferably, the timing gates are located adjacent the upper chute portion lower opening.

Preferably, each trough is defined between a pair of flanges which project inwardly with respect to the axis.

Preferably, the gates each pivot about a generally horizontal axis generally normal to the respective flanges.

Preferably, the troughs extend from adjacent the upper chute portion upper opening to adjacent the upper chute portion lower opening.

Preferably, the troughs are provided by a plurality of flanges spaced angularly about the longitudinal axis and project inwardly with respect thereto from the side wall, the flanges extending longitudinally downwardly so as to direct product moving downwardly along the chute.

Preferably, the flanges are located at the upper chute portion.

Preferably, the gates are mounted in the upper chute portion.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENTS

Figure 1:
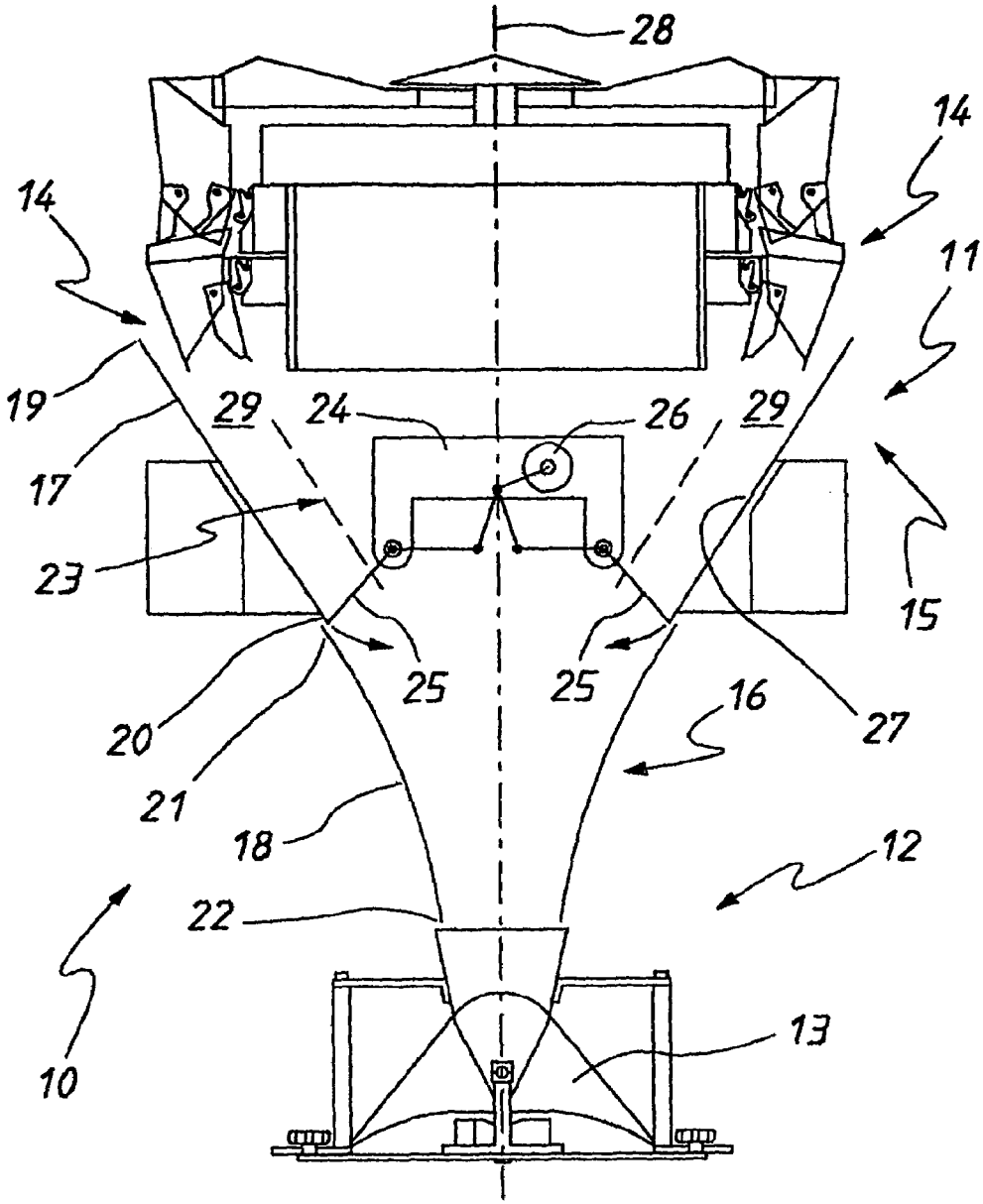
FIG. 1 is a schematic partially sectional side elevation view of a weigher, former and product delivery chute assembly therebetween.
Figure 2:
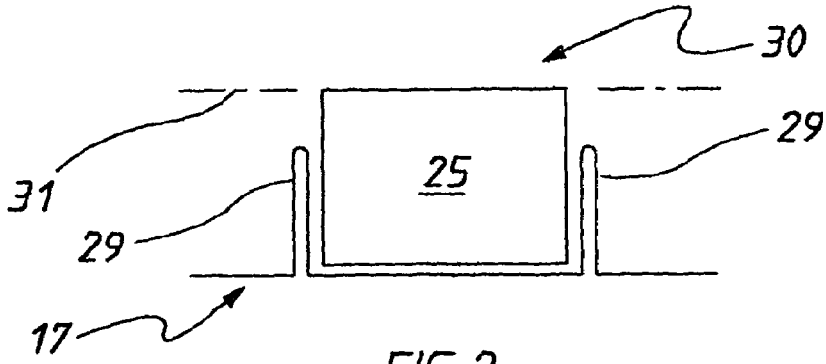
FIG. 2 is a schematic end elevation view of a portion of the chute employed in the chute assembly of FIG. 1.

In the accompanying drawings, there is schematically depicted a weigher 10 to deliver weighed batches of product to a chute assembly 11. The chute assembly 11 delivers the batches of product to a former 12 located above a packaging machine (not illustrated). The assembly 11 has a substantially vertical central axis.

The former 12 includes a former shoulder 13 through which a strip of bag material passes to be formed into a tubular configuration. The tubular bag material is longitudinally and transversely sealed and transversely cut so that discreet bags of product are formed. Product entering the former 12 is delivered to the interior of the tubular bag material.

The weigher 10 includes a plurality of buckets 14 which weigh the material and deliver the weighed batches of product to the chute assembly 11. The chute assembly 11 includes an upper chute portion 15 and a lower chute portion 16. The upper chute portion 15 includes a side wall 17 of frusto-conical configuration. More particular, the side wall 17 is downwardly converging from an upper edge 19 to a lower edge 20. The lower chute portion 16 has a side wall 18 of parabolic configuration, converging from an upper edge 21 to a lower edge 22. The lower edge 22 encompasses an opening through which product is delivered to the former 12. The upper edge 19 encompasses an opening through which the product is delivered from the weigher 10.

Mounted within the chute portion 11 is a timing gate device 23 including a mounting 24 upon which there is pivotally mounted a plurality of gates 25. The gates 25 are movable between a closed position (as depicted) blocking the flow of product from the weigher 10 to the former 12, and an open position allowing the flow of product. Each gate 25 is pivotally moved by means of a motor 26 that is operated in phase with operation of the above-mentioned packaging machine. In this respect, it should be appreciated that the gates 25 are located between the edges 19 and 22 and more particularly intermediate the edges 19 and 22. More preferably, the gates 25 engage the side wall 17 adjacent the lower edge 20 of the upper chute portion 15.

The upper chute portion 15 and lower chute portion 16 surround a generally vertical longitudinal axis 28. More particularly the internal surface 27 of the side walls 17 also surrounds the axis 28.

To aid in retaining the batches of product the surface 27 is provided with a plurality of inwardly projecting flanges 29 that are arranged angularly about the axis 28 and extend downwardly towards the edge 20. Each adjacent pair of flanges 29 cooperates to provide a trough 30 along which the batches of product pass.

Located between each pair of flanges 29 is a respective one of the gates 25. Each gate 25 pivots about a generally horizontal axis 31 that extends generally normal with respect to the flanges 29.

The above-described preferred embodiment has the advantage of engaging the product at a speed well below the speed that it would have reached had it been allowed to travel freely to the edge 22. Still further, when the product is released from the gates 25, it will gain velocity so that it will have an increased velocity when entering the former 12, relative to an arrangement in which the gates are located adjacent to former 12.

The claims defining the invention are as follows:

1. A product delivery chute assembly to extend between a weigher that provides batches of product and a packaging machine former that receives the batches to deliver the batches to the interior of tubular bag material, said assembly including:

a chute having a generally vertical longitudinal axis and a side wall surrounding said axis and converging downwardly from an upper chute portion to a lower chute portion, the lower chute portion surrounding a lower opening through which product batches are delivered to the former, the upper portion surrounding an upper opening through which product batches are delivered from the weigher, a plurality of troughs extending down said side wall and along which the batches travel after being delivered thereto by said weigher; and a timing gate device including timing gates in the chute and a motor assembly operably associated with the gates to cause movement thereof between a first position blocking the passage of the product batches along the troughs so as to retain a batch or batches of said product, and a second position releasing the batch or batches of product for movement along the chute for delivery to the lower opening, each gate being operatively associated with a respective one of the troughs to engage the batch or batches travelling along the trough; and wherein the upper chute portion has a lower edge surrounding an upper chute portion lower opening through which the product is delivered to the lower chute portion, with the timing gates being located adjacent the upper chute portion lower opening.

2. The assembly of claim 1, wherein the timing gates are mounted in the upper chute portion so as to release product to be delivered to the lower chute portion, with the upper chute portion also having said troughs.

3. The assembly of claim 1, wherein each trough is defined between a pair of flanges which project inwardly with respect to said axis.

4. The assembly of claim 3, wherein the gates each pivot about a generally horizontal axis generally normal to the respective flange.

5. The assembly of claim 1, wherein the troughs are provided by a plurality of flanges spaced angularly about said longitudinal axis and project inwardly with respect thereto from said side wall, the flanges extending longitudinally downwardly so as to direct product moving downwardly along the chute.

6. The assembly of claim 5, wherein said upper chute portion includes said flanges.

7. The assembly of claim 5, wherein said gates are mounted in said upper chute portion.

8. A product delivery chute assembly to extend between a weigher that provides batches of product and a packaging machine former that receives the batches to deliver the batches to the interior of tubular bag material, said assembly including:

a chute having a generally vertical longitudinal axis and a side wall surrounding said axis and converging downwardly from an upper chute portion to a lower chute portion, the lower chute portion surrounding a lower opening through which product batches are delivered to the former, the upper portion surrounding an upper opening through which product batches are delivered from the weigher, a plurality of troughs extending down said side wall and along which the batches travel after being delivered thereto by said weigher;

a timing gate device including timing gates in the chute and a motor assembly operably associated with the gates to cause movement thereof between a first position blocking the passage of the product batches along the troughs so as to retain a batch or batches of said product, and a second position releasing the batch or batches of product for movement along the chute for delivery to the lower opening, each gate being operatively associated with a respective one of the troughs to engage the batch or batches travelling along the trough; and wherein the upper chute portion has a lower edge surrounding an upper chute portion lower opening through which product is delivered to the lower chute portion and the troughs extend from adjacent the upper chute portion upper opening to adjacent the upper chute portion lower opening.

9. A product delivery chute assembly to extend between a weigher that provides batches of product and a packaging machine former that receives the batches to deliver the batches to the interior of tubular bag material, said assembly including:

a chute having a generally vertical longitudinal axis and a side wall surrounding said axis and converging downwardly from an upper chute portion to a lower chute portion, the lower chute portion surrounding a lower opening through which product batches are delivered to the former, the upper portion having an upper edge surrounding an upper opening and a lower edge past which product batches are delivered from the weigher, and a plurality of troughs extending down said side wall and along which the batches travel after being delivered thereto by said weigher;

a timing gate device including timing gates in the chute and a motor assembly operably associated with the gates to cause movement thereof between a first position blocking the passage of the product batches along the troughs so as to retain a batch or batches of said product, and a second position releasing the batch or batches of product for movement along the chute for delivery to the lower opening, each gate being operatively associated with a respective one of the troughs to engage the batch or batches travelling along the trough; and wherein each trough is longitudinally elongated so as to extend longitudinally downward of the upper chute portion toward the lower edge, with each trough being defined between a pair of longitudinally elongated flanges which project inwardly with respect to said axis.

10. The assembly of claim 9, wherein the upper chute portion has a lower edge surrounding an upper chute portion lower opening through which the product is delivered to the lower chute portion.

11. The assembly of claim 10, wherein the timing gates are located adjacent the upper chute portion lower opening.

12. The assembly of claim 10, wherein the troughs extend from adjacent the upper chute portion upper opening to adjacent the upper chute portion lower opening.

13. The chute assembly of claim 9, wherein the timing gates are located adjacent the lower edge.

* * * * *

US007310923C1

(12) INTER PARTES REEXAMINATION CERTIFICATE (0044th)

United States Patent
Taylor

(10) Number: US 7,310,923 C1
(45) Certificate Issued: Dec. 16, 2008

(54) TIMING GATES FOR A PACKAGING MACHINE

(75) Inventor: Alfred A. Taylor, Lugarno (AU)

(73) Assignee: TNA Australia Pty Limited, Lidcombe, NSW (AU)

Reexamination Request:
No. 95/001,033, Feb. 27, 2008

Reexamination Certificate for:

| | |
|---|---|
| Patent No.: | **7,310,923** |
| Issued: | **Dec. 25, 2007** |
| Appl. No.: | **10/371,161** |
| Filed: | **Feb. 21, 2003** |

(30) Foreign Application Priority Data

Feb. 22, 2002 (AU) ..... PS0706

(51) Int. Cl.
*B65B 1/32* (2006.01)
*B65B 9/10* (2006.01)

(52) U.S. Cl. ..... 53/502; 53/551; 177/25.18; 177/551; 222/77

(58) Field of Classification Search ..... None
See application file for complete search history.

(56) References Cited

FOREIGN PATENT DOCUMENTS

| | | | |
|---|---|---|---|
| JP | H05-35299 | Y2 | 9/1993 |
| JP | 08-114492 | A | 5/1996 |
| JP | 2001-289702 | A | 10/2001 |

*Primary Examiner*—Jeffrey L. Gellner

(57) ABSTRACT

A chute assembly to be positioned between a weigher and a former of a packaging machine. The chute assembly includes a timing gate device including a plurality of timing gates that regulates the delivery of batches of product from the weigher to the former. The gates are driven between a first position at which they inhibit the delivery of batches of product to the former and a second position permitting the flow of batches of product to the former.

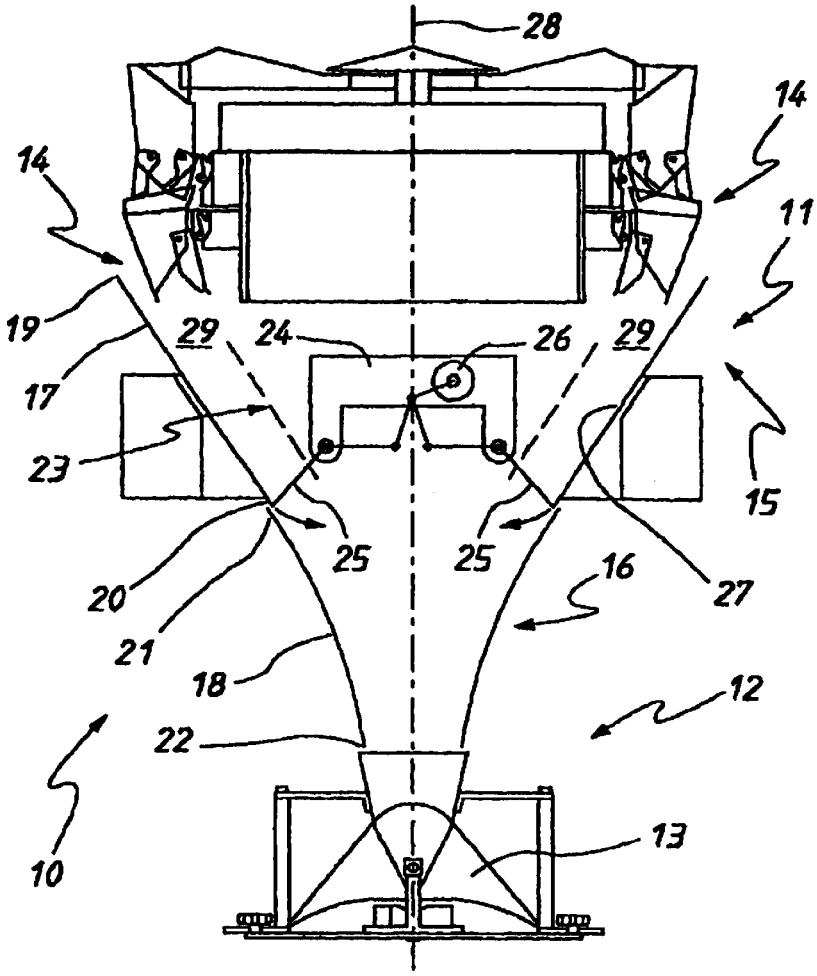

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1–13 are cancelled.

* * * * *